US009816282B2

(12) United States Patent
Chick

(10) Patent No.: US 9,816,282 B2
(45) Date of Patent: Nov. 14, 2017

(54) SELF CLEANING SWIMMING POOL FILTER

(71) Applicant: Robert Stanley Chick, Tyler, TX (US)

(72) Inventor: Robert Stanley Chick, Tyler, TX (US)

( * ) Notice: Subject to any disclaimer, the term of this patent is extended or adjusted under 35 U.S.C. 154(b) by 768 days.

(21) Appl. No.: 13/987,635

(22) Filed: Aug. 16, 2013

(65) Prior Publication Data

US 2015/0048036 A1 Feb. 19, 2015

(51) Int. Cl.
*E04H 4/12* (2006.01)
*B01D 37/00* (2006.01)

(52) U.S. Cl.
CPC ..... *E04H 4/1245* (2013.01)

(58) Field of Classification Search
None
See application file for complete search history.

(56) References Cited

U.S. PATENT DOCUMENTS 556,725 A * 3/1896 Farwell ..... B01D 24/32 210/125
740,574 A * 10/1903 Kohlmeyer ..... B01D 33/00 210/326
810,020 A * 1/1906 Applegate ..... B01D 33/06 210/396
2,243,559 A * 5/1941 Griffith ..... B01D 29/48 210/107
2,979,733 A * 4/1961 Saint Clair ..... E04H 4/1681 137/577.5
3,207,312 A * 9/1965 Griswold ..... B01D 24/105 137/625.21
3,221,886 A * 12/1965 Lamort et al. ..... B01D 21/0012 209/170
3,297,163 A * 1/1967 Landon ..... B01D 29/41 210/167.14
3,311,235 A * 3/1967 Ahlfors ..... D21D 5/06 209/270
3,365,064 A * 1/1968 Horan, Jr. ..... B01D 29/668 210/167.13
3,420,376 A * 1/1969 Smith ..... B01D 24/12 210/167.13
3,471,021 A * 10/1969 Prizler ..... B01D 29/668 137/625.46
3,491,884 A * 1/1970 Baker ..... B01D 24/167 210/167.13
3,511,374 A * 5/1970 Beal ..... B01D 29/15 209/258
3,581,895 A * 6/1971 Howard ..... B01D 24/14 210/108
3,760,947 A * 9/1973 Morrison ..... C02F 1/763 210/167.11
3,786,921 A * 1/1974 Johnson ..... B01D 35/147 210/130
3,825,120 A * 7/1974 Takahashi ..... B01D 24/12 210/104

(Continued)

*Primary Examiner* — Robert James Popovics

(57) ABSTRACT

Self-cleaning swimming pool filter apparatus having a hollow cylindrical filter in a filter housing and a cleaning tube rotatable with respect to the filter, with a plurality of filter cleaning orifices, a pump connected to circulate swimming, pool water through the filter in the operational filtering mode and through the cleaning tube and filter cleaning orifices in the filter cleaning mode, according to the setting of directional valves.

1 Claim, 5 Drawing Sheets

(56) References Cited

U.S. PATENT DOCUMENTS 3,834,535 A * 9/1974 Portyrata ..... B01D 29/15 210/108
3,859,214 A * 1/1975 Lang ..... B01D 29/15 210/167.14
3,969,248 A * 7/1976 Whitmer ..... B01D 35/18 210/126
4,194,975 A * 3/1980 Baker ..... B01D 35/153 210/108
4,284,500 A * 8/1981 Keck ..... B01D 29/15 209/250
4,297,209 A * 10/1981 DeVisser ..... B01D 29/17 210/107
4,308,142 A * 12/1981 Braukmann ..... B01D 29/15 210/355
4,545,905 A * 10/1985 Poe ..... B01D 35/027 137/625.46
4,564,451 A * 1/1986 Cohen ..... B01D 29/117 137/625.46
4,574,048 A * 3/1986 van den Broek .... B01D 29/114 210/136
4,607,399 A * 8/1986 Yovanofski ..... E04H 4/12 137/412
4,676,914 A * 6/1987 Mills ..... E04H 4/1245 210/108
4,808,234 A * 2/1989 McKay ..... A47L 9/20 134/144
4,818,402 A * 4/1989 Steiner ..... B01D 29/23 210/411
4,923,600 A * 5/1990 Krofta ..... B01D 29/114 210/107
5,087,365 A * 2/1992 Davis ..... B01D 29/118 162/272
5,124,029 A * 6/1992 Fjallstrom ..... D21D 5/046 209/250
5,139,667 A * 8/1992 Reneau, Jr. ..... B01D 29/01 210/319
5,152,891 A * 10/1992 Netkowicz ..... B01D 29/23 209/250
5,164,079 A * 11/1992 Klein ..... B01D 29/117 210/186
5,183,568 A * 2/1993 Lescovich ..... B01D 29/118 209/303
5,192,429 A * 3/1993 Bader ..... B01D 29/15 210/170.09
5,238,473 A * 8/1993 Femiani ..... B01D 46/0056 55/290
5,246,580 A * 9/1993 Stedfeldt ..... B01D 29/115 210/108
5,277,804 A * 1/1994 Gerteis ..... B04B 3/025 210/232
5,286,378 A * 2/1994 Gerteis ..... B04B 3/025 210/232
5,367,723 A * 11/1994 Pleva ..... E04H 4/12 137/428
5,384,045 A * 1/1995 Chmielewski ..... B01D 29/21 134/138
5,423,977 A * 6/1995 Aoki ..... B01D 33/073 210/107
5,459,886 A * 10/1995 Payne ..... E04H 4/1209 137/414
5,464,542 A * 11/1995 Grienberger ..... B01D 29/15 210/393
5,490,924 A * 2/1996 Macia ..... B01D 29/15 210/257.1
5,505,844 A * 4/1996 Porter ..... B01D 24/10 210/167.13
5,591,329 A * 1/1997 Davidson ..... B01D 29/21 210/193
5,595,655 A * 1/1997 Steiner ..... B01D 29/15 210/391
5,667,683 A * 9/1997 Benian ..... B01D 29/15 210/409
5,683,583 A * 11/1997 Deskins ..... B01D 24/22 210/410
5,785,846 A * 7/1998 Barnes ..... E04H 4/1209 210/167.12
5,824,229 A * 10/1998 Larkey ..... B01D 29/117 210/108
5,882,528 A * 3/1999 Davidson ..... B01D 29/21 210/167.13
5,989,419 A * 11/1999 Dudley ..... B01D 41/04 134/138
6,022,481 A * 2/2000 Blake ..... E04H 4/1272 15/1.7
6,056,873 A * 5/2000 Hartley ..... A01K 63/045 119/226
6,136,202 A * 10/2000 Foreman ..... B01D 33/073 210/107
6,156,213 A * 12/2000 Dudley ..... B01D 41/04 134/138
6,267,879 B1 * 7/2001 Gil ..... B01D 29/114 210/107
6,419,842 B1 * 7/2002 Kupka ..... F26B 7/00 210/325
6,497,814 B1 * 12/2002 Alexander ..... E04H 4/1209 134/170
6,568,428 B2 * 5/2003 Pecci ..... F16K 27/003 137/595
6,578,590 B2 * 6/2003 Leblond ..... A46B 13/001 134/138
6,878,293 B1 * 4/2005 Portyrata ..... B01D 24/105 137/106
6,958,118 B2 * 10/2005 Hill ..... B01D 36/02 210/108
6,977,040 B2 * 12/2005 McCune ..... B01D 35/16 210/248
7,083,735 B2 * 8/2006 Laing ..... B01D 29/114 210/391
7,192,528 B2 * 3/2007 Prochaska ..... B01D 29/46 210/108
7,294,257 B2 * 11/2007 Jackson ..... A01K 63/045 119/259
7,311,823 B2 * 12/2007 Brooke ..... B01D 41/04 134/172
7,468,134 B2 * 12/2008 Hoang ..... A01K 63/045 210/150
7,662,296 B2 * 2/2010 Pancaldi ..... B01D 29/23 100/110
7,708,882 B2 * 5/2010 Kobayashi ..... B01D 61/18 210/209
7,794,591 B2 * 9/2010 Nibler ..... C02F 1/001 210/167.12
7,815,796 B2 * 10/2010 Nibler ..... B01D 29/114 210/167.12
7,849,877 B2 * 12/2010 Tan ..... F16K 11/0853 137/625.46
7,951,293 B2 * 5/2011 Nibler ..... E04H 4/1209 210/167.11
8,069,989 B1 * 12/2011 Gordon ..... B01D 29/114 210/408
8,137,545 B2 * 3/2012 Nibler ..... C02F 1/001 210/167.12
8,173,011 B2 * 5/2012 Nibler ..... E04H 4/1209 210/167.11
8,524,075 B1 * 9/2013 Quintel ..... B01D 29/232 210/108
8,910,662 B2 * 12/2014 Tan ..... F16K 11/0853 137/625.46
9,061,226 B2 * 6/2015 Love ..... B01D 33/073
9,403,108 B2 * 8/2016 Broussard ..... B01D 29/52
9,486,743 B2 * 11/2016 Rantala ..... B01D 61/14
9,539,529 B2 * 1/2017 Mullis ..... B01D 35/02
9,561,454 B2 * 2/2017 Browning ..... B01D 29/035
2002/0008068 A1 * 1/2002 Anderson ..... B01D 29/15 210/741
2002/0130092 A1 * 9/2002 McCune ..... B01D 35/16 210/791

(56) References Cited

U.S. PATENT DOCUMENTS

| | | | | |
|---|---|---|---|---|
| 2002/0166578 | A1* | 11/2002 | Leblond | B08B 3/04 134/28 |
| 2005/0045568 | A1* | 3/2005 | Laing | B01D 29/114 210/791 |
| 2006/0151366 | A1* | 7/2006 | Hoang | A01K 63/045 210/95 |
| 2009/0277848 | A1* | 11/2009 | Slade | C02F 1/001 210/793 |
| 2010/0270173 | A1* | 10/2010 | Anderson | C02F 1/4674 205/751 |
| 2014/0001128 | A1* | 1/2014 | Mullis | B01D 35/02 210/793 |
| 2014/0175021 | A1* | 6/2014 | Ueyama | B63J 4/002 210/747.6 |
| 2015/0048036 | A1* | 2/2015 | Chick | E04H 4/1245 210/791 |
| 2015/0225257 | A1* | 8/2015 | Inoue | C02F 1/325 210/143 |
| 2016/0032603 | A1* | 2/2016 | Hegi | B01D 29/682 210/248 |

* cited by examiner

SELF CLEANING SWIMMING POOL FILTER

FIELD OF THE INVENTION

The present invention relates to the fields of swimming pools, spas and fluid filtering, and most particularly, to self-cleaning water filters.

BACKGROUND OF THE INVENTION

Swimming pools are common in recreational and residential locations and are a virtual requirement for every hotel and motel. In order to properly serve their intended purpose, swimming pools require care and maintenance. Almost all swimming pools comprise a water recirculating system, with a filtering device to separate out the dirt, airborne dust, pollen and other entrained particulate, which finds its way into the system.

The recirculating water is passed through a cleaning filter of a type well known in the prior art. The filter element is generally in the form of a pleated cylinder of porous material, with an open inside diameter. The filter element is contained in a pressure tight housing and water is pumped from the swimming pool to pass through the pleated porous material of the element before being returned to the pool. In this manner, entrained particulate is entrapped on the porous filter material and the water returned to the pool is cleaned.

As a normal part of swimming pool maintenance, the filter element must be cleaned or replaced at intervals. Replacement becomes expensive over time, so that cleaning and reusing is much preferred. Cleaning requires taking the element out of the housing and washing it with a hose to remove collected particulate and maintain filtering efficacy. While this is something that a homeowner can do, it is a somewhat onerous task, best done bare-footed, in a bathing suit.

Gordon's U.S. Pat. No. 8,069,989, a "SELF CLEANING WATER FILTER SYSTEM", discloses a device apparently for use in municipal or similar drinking water supply systems The device addresses the cleaning need by using vibration and pulsating reverse flow to dislodge and remove particulate from a filter element. This solution may be effective for the intended application. However, the vibratory and pulsating elements are costly. Moreover, the reversing forces on seals, components and connections will eventually cause fatigue failures, so as to compromise reliability and require careful maintenance.

Objects of the present invention are first, to provide a simple, reliable method and apparatus for cleaning water filters and secondly, to minimize any need for operator involvement or oversight. Yet another object is to minimize routine maintenance of the apparatus.

SUMMARY OF THE INVENTION

In one preferred embodiment, the objectives of the present invention are addressed by providing flow control valves, pipes and water jets to reconfigure a recirculating water system for filter cleaning. In the operational, filtering mode, water flows into the open center of a hollow cylindrical filter, through the pleated, porous material of the filter element to entrap particulate before circulating back to the pool. For filter cleaning, the control valves redirect incoming water flow to a plurality of nozzles arrayed along the length of a cleaning tube axially located in the center of the filter. Cleaning jet orifices arrayed along its length of are placed proximate the filter surface to impinge upon and dislodge the entrapped foreign matter and particulate. The spent water becomes wastewater and carries the particulate off for disposal. The cleaning tube is driven manually or by power to rotate slowly and fully clean particulate from the filter surfaces.

In a second embodiment, the present invention is expressed in a configuration wherein the incoming pool water is normally directed at the outer periphery of the hollow cylindrical filter body, so that particulate is entrapped at the external surfaces of the porous, filter element material. In this mode, filtered water is returned to the pool from the hollow center. Flow control valves are provided to reconfigure the system in a filter cleaning mode, wherein incoming flow is directed to an axial array of orifices along a cleaning tube located proximate the filter periphery. Cleaning water jets from these orifices impinge on the external surfaces of the filter element, dislodging entrapped particulate for disposal. The filter body is driven to slowly rotate, so as to fully clean the external surfaces of the filter element.

BRIEF DESCRIPTION OF THE DRAWINGS

The accompanying drawings are incorporated into the specification to assist in explaining the present inventions. The drawings illustrate examples of how the inventions can be made and used and are not to be construed as limiting the inventions to only those examples. The various advantages and features of the present inventions will be apparent from a consideration of the drawings in which.

DETAILED DESCRIPTION OF THE DRAWINGS

Figure 1:
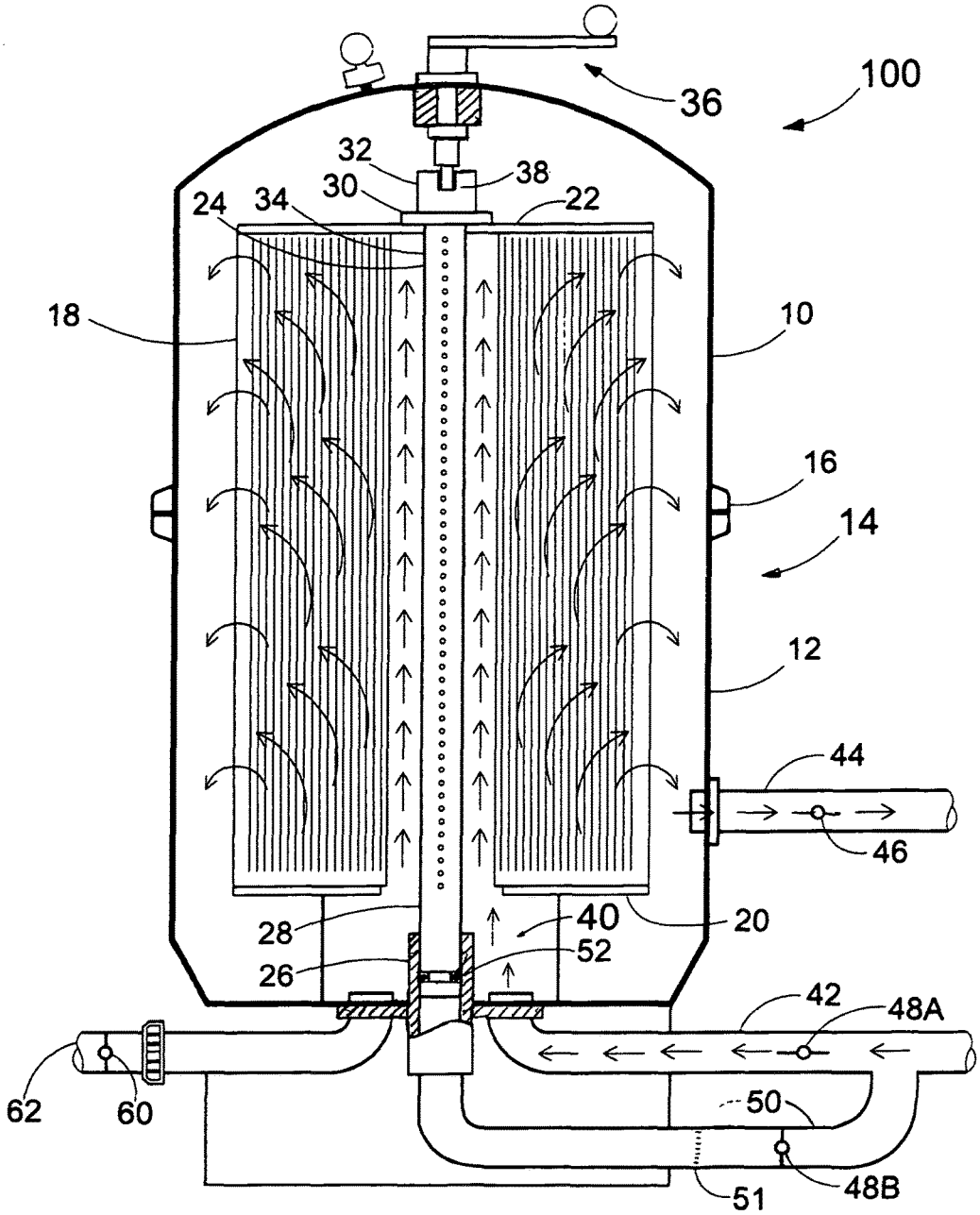
FIG. 1 is a cross-section view of a preferred embodiment of the self-cleaning water filter of the present inventions as it appears in the operational, filtering mode.

The present inventions are described in the following by referring to the drawings of examples of how the inventions can be made and used. In these drawings, reference characters are used throughout to indicate like or corresponding parts. The embodiments shown and described herein are exemplary. Many details are well known in the art, and as such are neither shown nor described.

Figure 2:
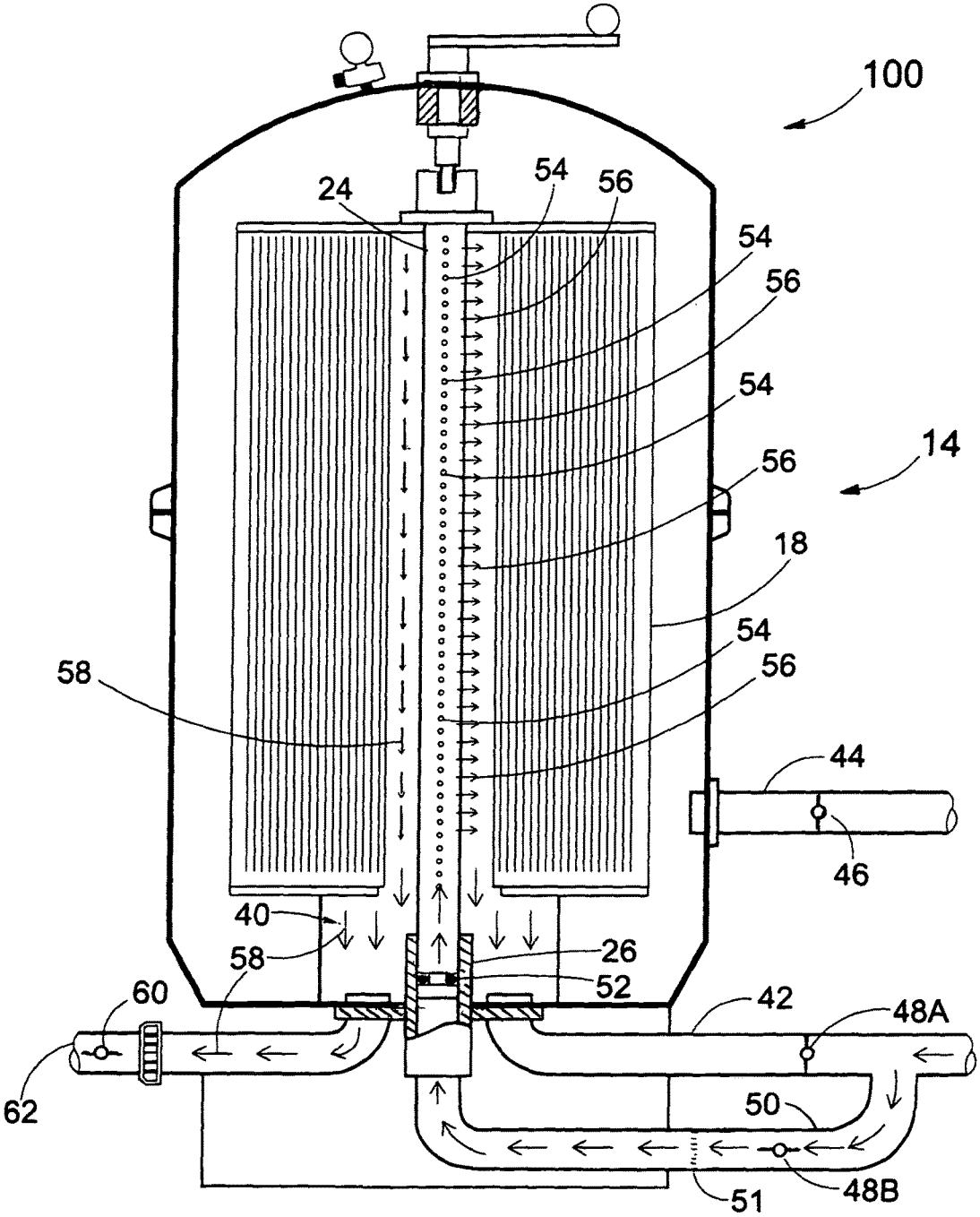
FIG. 2 is a cross-section view of the preferred embodiment FIG. 1 as it appears in the self-cleaning mode.

FIGS. 1 and 2 are a cross-sections of a preferred embodiment of self-cleaning water filter 100 of the present inventions. Here we see upper portion 10 and lower portion 12 of filter can 14, clamped together and sealed by clamping ring 16. Hollow cylindrical filter body 18, comprising a filtering element of porous material, pleated to expand its particulate entrapping surface, is contained inside of can 14, where it is held between bottom plate 20 and top plate 22. Cleaning water tube 24 extends downward through the hollow inside diameter of filter body 18. Bushing 26 stabilizes the lower end 28 of cleaning tube 24, with washer 30 and slotted fitting 32 supporting upper end 34. Spade end 38 of hand crank assembly 36 engages slotted fitting 32 to facilitate rotation of cleaning tube 24 and also limit its upward movement, as well as that of filter body 18.

Embodiment 100, is shown in the operational mode in FIG. 1, with valves 46 and 48A open, and valves 48B and 60 closed. Swimming pool water is pumped into lower cavity 40 of filter can 14 through inlet line 42, where it proceeds upwardly into the hollow interior of filter body 18. Filter body 18 comprises a filtering element of porous fabric folded on itself in a multiplicity of pleats to provide an expanded filtering area. As pool water passes through filter body 18, foreign matter and particulate are entrapped on the surface of its porous material and left behind in the hollow interior as water circulates back to the pool through the open valve 46 of return line 44.

In FIG. 2 it is seen how return line 44 valve 46, inlet line 42 valve 48A, cleaning line 50 valve 48B and waste drain 62 valve 60, are operated manually or remotely, convert embodiment 100 from the filtering mode to the filter cleaning mode. Valves 48A and 48B are actuated to divert flow from inlet line 42 to cleaning line 50, which supplies jetting tube 24 through straining screen. Screen 51 is passive, with no through flow in FIG. 1, but stops particulate that might clog cleaning jet orifices 54 in the filter cleaning mode of FIG. 2.

Cleaning tube 24 has a series of cleaning jet orifices 54 arrayed along its length, with a total flow area significantly less than that of inlet lines 42 or 50, thereby provide a much higher velocity for water jets 56. Entrapped foreign matter and particulate 58 are dislodged from filter body 18 by high velocity water jets 56. The dislodged matter and particulate 58 wash downwardly with spent jetting water as waste water, into filter can lower cavity 40, through open waste drain valve 60, and off to waste drain outlet 62. Here we should note that cleaning water tube 24 is free to rotate relative to filter body 18 in bushing 26, so as to fully expose the surface of filter body 18 to water jets 56, while sealing member 52 prevents loss of water pressure.

Figure 3:
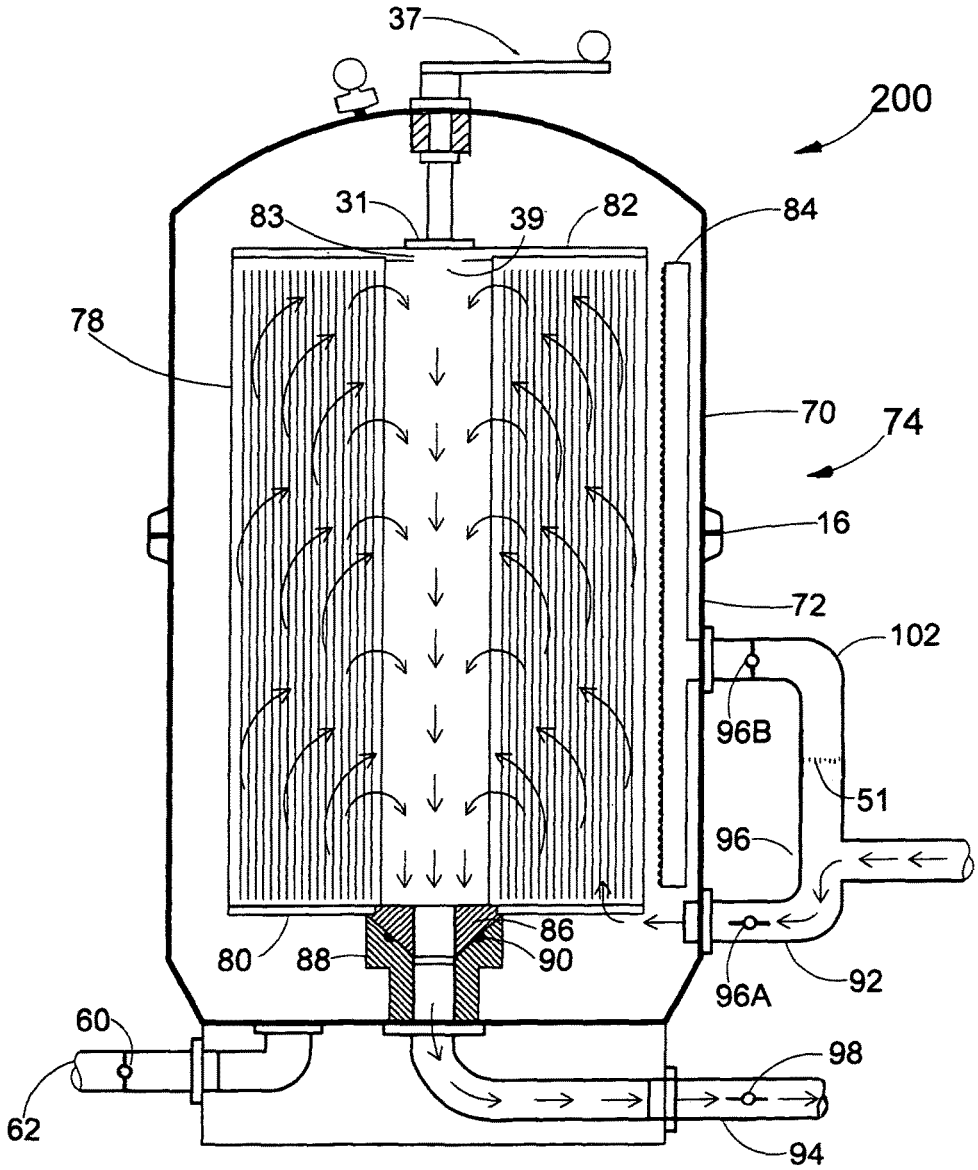
FIG. 3 is a cross-section view of a second preferred embodiment of the present inventions as it appears in the operational, filtering mode.
Figure 4:
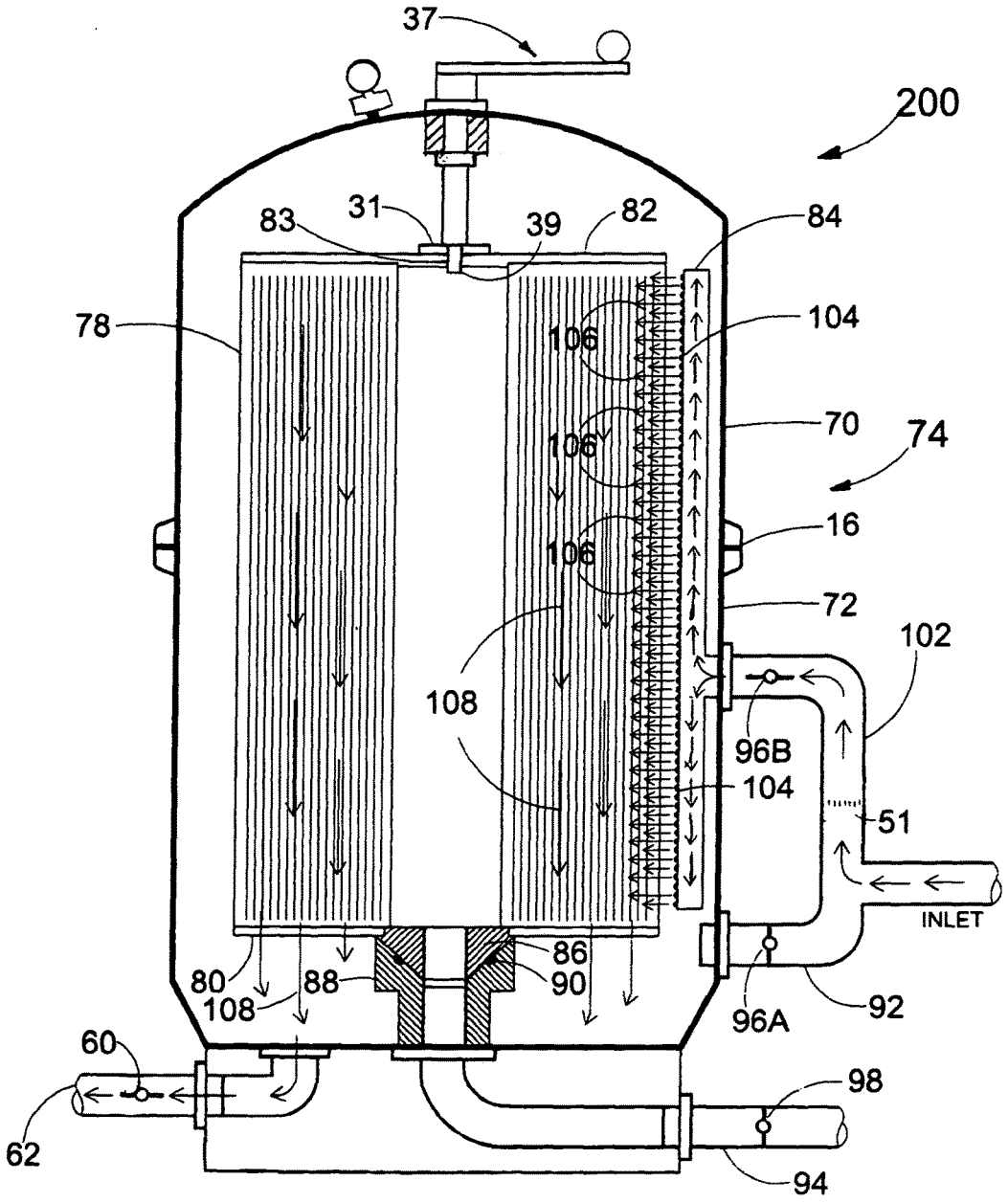
FIG. 4 is a cross-section view showing the embodiment of FIG. 3 as it appears in the self-cleaning mode.

FIGS. 3 and 4 are cross-section views of a second preferred embodiment 200 of the self-cleaning water filter of the present inventions. Here we see upper can portion 70 and lower can portion 72 of filter can 74, clamped together and sealed by clamping ring 16. Hollow cylindrical filter body 78 is contained inside of can 74, where it is held between bottom plate 80 and top plate 82.

Cleaning tube 84 extends downwardly proximate the outside diameter of filter body 78. Conical plastic fitting 86 seats in matching plastic socket 88, where it is water lubricated to rotate and centrally support filter body 78. Socket seal 90 prevents leakage. Spade end 39 of hand crank assembly 37 engages slot 83 in top plate 82 to facilitate rotation of filter body 78 and hold it in its central position. Washer 31 serves to limit the upward movement of filter body 78.

In filtering operation, closed valve 96B and open valve 96A direct swimming pool water through inlet line 92 to filter can 74. Waste valve 60 is closed, so the water then passes through filter body 78 into its hollow interior. Filter body 78 comprises a porous material folded on itself in a multiplicity of pleats to maximize filtering area. Foreign matter and particulate are entrapped on its exterior surfaces. Water circulates to the pool through return line 94 and open valve 98.

In FIG. 4 it is seen how, in filter cleaning mode, closing valve 96A and opening valve 96B direct swimming pool water through cleaning line 102 and straining screen 51 to cleaning tube 84. Waste drain valve 60 is also opened, so as to convert embodiment 200 from the filtering mode to the filter cleaning mode of operation. Valves 96A, 96B, 90 and 60 may be actuated either manually or remotely. Cleaning tube 84 has an of cleaning jet orifices 104 with a total flow capacity significantly less than the inlet flow volume, thus maintaining pressure for elevated velocity water jets 106. Cleaning tube 84 is positioned proximate filter body 78 so that cleaning jets 106 impinge upon its surface to dislodge entrapped foreign matter and particulate 108. Spent cleaning jet water becomes wastewater, which carries the dislodged foreign matter and particulate 108 down to filter can lower portion 72 and out through open waste drain valve 60 and outlet 62.

As previously described, spade end 39 of hand crank assembly 37 engages slot 83 to facilitate rotation of filter body 78, hold it in its central position and limit its upward movement. Water lubricated plastic fitting 86, seated in plastic socket 88, supports filter body 78 for rotation, so as to allow full cleaning of the external surfaces of filter 78.

Figure 5:
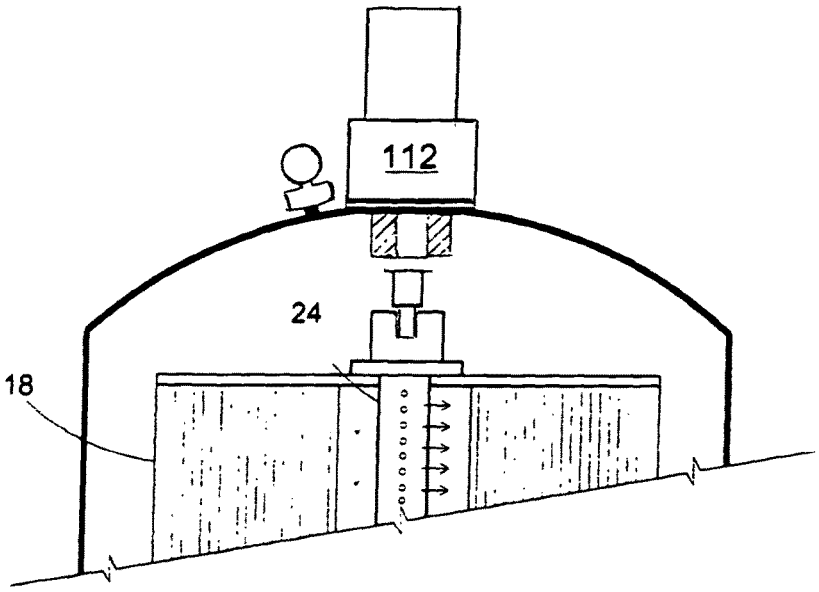
FIG. 5 shows how an external electric motor may be used provide relative rotation.

FIG. 5 shows how the function of a manually operated crank is performed by externally mounted, electric drive, gear reduction unit 112 for remote controlled operation. Here, whenever the system is configured for filter cleaning, drive unit 112 is powered to rotate cleaning tube 24, with respect to filter body 18 so as to clean all of the foreign matter and particulate collected on the surface of filter body 18.

Figure 6:
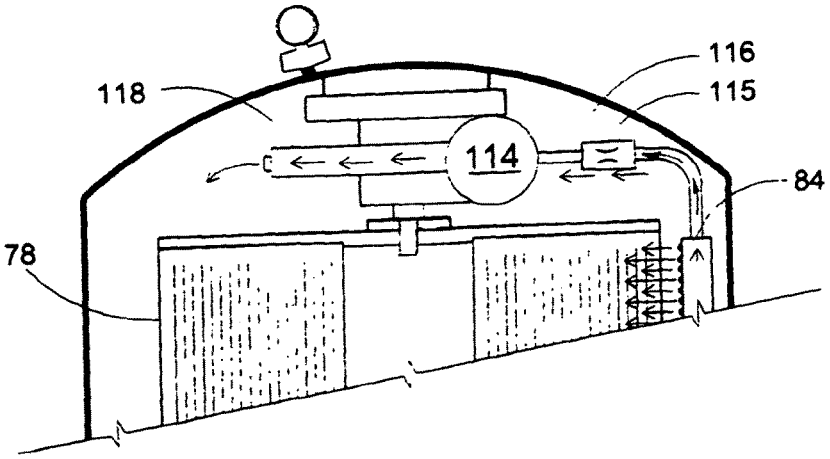
FIG. 6 shows how an internal hydraulic motor may be used provide relative rotation.

FIG. 6 shows how the function of a manual crank is performed by internally mounted, hydraulic drive, gear reduction unit 114. Pressurized water taken from cleaning tube 84 through flow restrictor 115 in motor feed line 116 drives hydraulic rotary unit 114 to rotate filter body 78. The spent water spills from motor exhaust 118 to join the wastewater and particulate outflow. In an alternative configuration, cleaning tube 84 may be driven to pivot around filter body 18, so long as there is the relative rotation needed to clean all of the foreign matter and particulate collected on the surface of filter body 18.

Even though many features and long needed advantages of the present inventions have been described in the drawings and accompanying text, the description is illustrative only. Changes may be made in details, especially in matters of shape, size, and arrangement of the parts within the scope and principles of the inventions. The restrictive description and drawings of the specific examples above do not point out what an infringement of this patent would be, but are to provide at least one explanation of how to use and make the inventions. The limits of the inventions and the bounds of the patent protection are measured by and defined in the following claims.

I claim:

1. A method of filtering swimming pool water comprising the steps of:

providing a filtration apparatus comprising:

a generally cylindrical filter housing including inlet and outlet connections for swimming pool water entrance flow and water return flow, and alternative cleaning water and wastewater connections;

a hollow, generally cylindrical filter body comprising a porous pleated filter material located within said generally cylindrical filter housing;

a cleaning water tube having a plurality of cleaning jet orifices axially arrayed along the length thereof, located within said filter housing so that cleaning jet flows are directed at the porous pleated material;

a hydraulic drive unit located within said filter housing, above said filter body, and fluidically connected to said cleaning water tube, for rotating said hollow, generally cylindrical filter body relative to said cleaning water tube so that the porous pleated filter material surface is fully exposed to the cleaning jet flows;

flow control valves to optionally divert the water entrance flow to the cleaning jet orifices, and also dispose of dislodged particulate and spent jetting water as wastewater;

a water pump connected to circulate swimming pool water through said inlet connection, through said porous pleated filter material and back to the pool through the outlet connection;

pumping water from the swimming pool through said filtration apparatus; and returning filtered water exiting said filtration apparatus to the swimming pool.

* * * * *